United States Patent [19]

Simich

[11] 4,147,188

[45] Apr. 3, 1979

[54] BALE-TIE WIRE

[75] Inventor: Emil Simich, Chicago, Ill.

[73] Assignee: A. J. Gerrard & Company, Des Plaines, Ill.

[21] Appl. No.: 862,104

[22] Filed: Dec. 19, 1977

[51] Int. Cl.[2] ..... B21F 15/04

[52] U.S. Cl. ..... 140/101; 140/73; 24/27

[58] Field of Search ..... 140/73, 101, 104; 24/27; 289/1.2, 1.5, 4

[56] References Cited

U.S. PATENT DOCUMENTS

| | | | |
|---|---|---|---|
| 3,168,912 | 2/1965 | Marica | 140/101 |
| 3,949,450 | 4/1976 | Bailey | 140/73 |

*Primary Examiner*—Lowell A. Larson

*Attorney, Agent, or Firm*—Emrich, Root, O'Keeffe & Lee

[57] ABSTRACT

A bale-tie wire for use with press platens in a baling press for baling materials includes a body portion having looped members formed at each end of the bale-tie wire body portion with a portion of each of the looped members bent out of the plane in opposite directions of each of the respective looped ends. Each of the looped members includes rearwardly extending legs which engage the body portion of the bale-tie wire with one of the extending leg portions being substantially longer than the leg portion of the other end looped member to provide a bale-tie wire structure which substantially reduces the force necessary for the engagement of the looped end portions of the bale-tie wire.

2 Claims, 7 Drawing Figures

BALE-TIE WIRE

BACKGROUND OF THE INVENTION

This invention relates to bale-tie wires and is directed to novel improvements in the design and structure of bale-tie wires.

In the past, bale-tie wires have been considered the most desirable method of securing and holding baled materials which are released from baling presses. Because of the large stresses and pressures involved in compressing baled materials, it is necessary to utilize large diameter bale-tie wire as a securing medium with the bale-tie wire commonly made having formed looped ends thereon. The looped ends are generally closed with identically extending legs looped about the major axis of the wire. When the bale-tie wires are positioned about a compressed bale, the looped ends are assembled into a knotted joint. Primarily, such bale-tie wires have been intended for hand tieing, although mechanical devices have been utilized to reduce operator fatigue in engaging the looped ends of the knot together. Not unexpectedly, such large diameter bale-tie wires are very rigid and difficult to manually handle because of the excessive pressures necessary for simultaneously deforming the looped ends apart to provide engagement of the looped ends into a tied-knot. However, the labor costs and the forces required in securing the looped ends together are a disadvantage of such bale-tie wires and has resulted in the necessity of utilizing increased lengths of wire to provide flexibility to permit manual joining and completion of the looped ends together. To overcome such difficulties bale-tie wires having opened looped ends have been developed; however, such wires cause snarling of the wires during shipment and non-usage.

SUMMARY OF THE INVENTION

It is one object of the present invention to provide a novel bale-tie wire including loops at each end having rearwardly extending legs of unequal length to provide a bale-tie wire requiring half the force necessary to assemble the looped ends together to form a completed knot.

It is another object of the present invention to provide a bale-tie wire having looped ends and legs which converge to engage the body portion of the bale-tie wire to form a closed loop to prevent the bale-tie wires from snarling together during shipment and non-usage.

The bale-tie wire of the present invention is useful in conjunction with a pair of press platens in the baling press for baling materials. The bale-tie wire includes looped end portions formed at each end of the wire and with a portion of each looped end bent out of the plane of the respective loop in opposite directions thereof. Each of the looped ends includes rearwardly extending legs or members which engage the body portion of the bale-tie wire. Each one of the looped ends includes extension legs which are converged to engage the body portion of the bale-tie wire to form a closed loop with the looped ends with a portion of the loop bent out of the plane of each respective loop in opposite directions thereof. Also, one extension leg of one of the looped ends is substantially longer in length than the extension leg of the opposite looped end to provide that one of the looped ends is larger than the other looped end.

To engage the looped ends together, the looped ends are assembled by exerting a force to push together the looped end members in a wedging action between the wire and the leg extensions. Thus, the looped ends, one having a shorter extending leg and the other a longer extending leg, cannot be simultaneously deflected apart. During the assembly operation, the longer looped end will come into contact with the shorter extending leg and bias the same away from the body portion of the wire to permit the larger looped end to encircle the body portion of the bale-tie wire. Subsequently, the shorter looped end will proceed to contact and bias open the larger looped end and extending leg away from the body portion of wire to permit smaller looped end to encircle the body portion of the wire. The looped ends are then pulled together to complete the engagement of the looped ends into a loop.

The present invention reduces the assembly effort necessary to complete the engagement of the looped end, either manually or when mechanical devices are utilized, and provides a bale-tie wire having entirely closed loops to prevent the bale-tie wires from entanglement together during shipment and non-usage. Also, the present invention reduces the converging or assembly force in half over conventional bale-tie wire looped end structures to provide a novel bale-tie wire for use in retaining baled materials released from a baling press.

DETAILED DESCRIPTION

Figure 1:
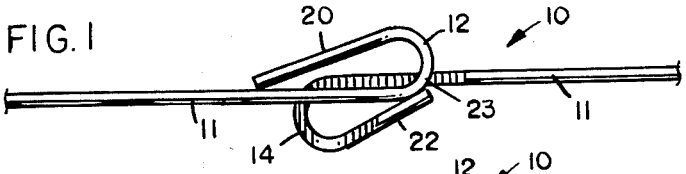
FIG. 1 is a fragmentary top plan view showing the looped ends of the bale-tie wire in accordance with the present invention in position for engagement together.
Figure 2:
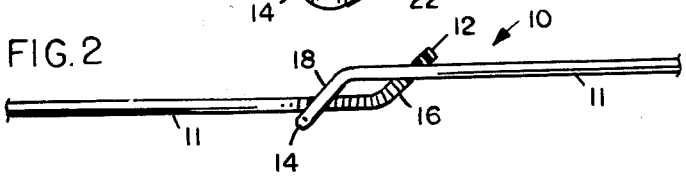
FIG. 2 is a fragmentary side-elevation view of the bale-tie wire structure in accordance with FIG. 1.
Figure 3:
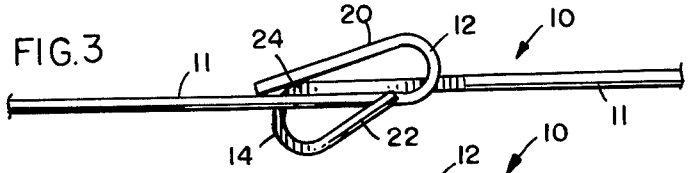
FIG. 3 is a fragmentary top plan view showing the looped ends in partial engaging position in accordance with the present invention.
Figure 4:
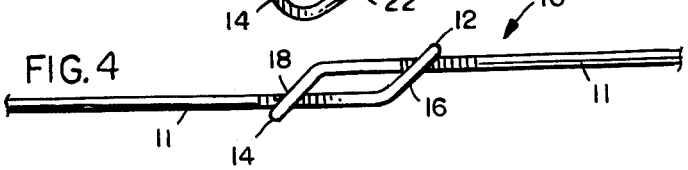
FIG. 4 is a fragmentary side-elevation view of the bale-tie structure in accordance with FIG. 3.
Figure 5:
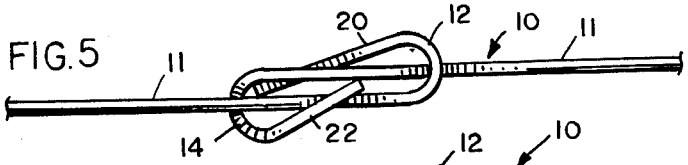
FIG. 5 is a fragmentary top plan view showing the looped ends in accordance with the present invention in overlapping engaged position.

Referring now to the drawings wherein like reference numerals have been used throughout the several views to identify the same or similar parts, in FIGS. 1–7 there is shown the bale-tie wire 10 in accordance with the present invention. The bale-tie wire 10 includes a body portion 11 and looped end portions 12 and 14 formed at each end of the bale-tie wire 10. A portion 16 and 18 of each of the looped ends 12 and 14, respectively, is bent out of the plane of the respective loop in opposite directions thereof. Each of the looped ends 12 and 14 includes rearwardly extending legs 20 and 22 which converge to engage the body portion 11 of the bale-tie wire 10 to form a closed loop, a structure as shown in FIGS. 1, 3 and 5.

Figure 6:
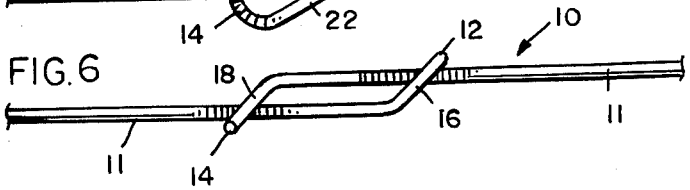
FIG. 6 is a fragmentary side-elevation view of the structure in accordance with FIG. 5.

As shown in FIGS. 2, 4 and 6, the looped ends 12 and 14 are formed with portions 16 and 18, respectively out of the plane of each of the respective looped ends in opposite directions thereof. Also, as shown in FIGS. 1, 3 and 5, the extending leg or member 20 of the looped end 12 is substantially longer in length than the extending leg 22 of the opposite looped end 14, thus providing a looped end 12 which is larger than the opposite looped end 14.

To engage the looped ends 12 and 14 together, the looped ends are positioned, as shown in FIG. 1, such that the looped ends 12 and 14 abut one another. As the looped ends 12 and 14 are pushed together, the end portion 23 of looped end 12 engages the shorter extending leg or member 22 of looped end 14 to bias leg 22 away from the body portion 11 of the bale-tie wire 10 to an intermediate position, as shown in FIG. 3. In such a position, the looped end 12 completely encircles the body portion 11 of the bale-tie wire 10. Further movement of the looped ends 12 and 14 together results in the end portion 24 of looped end 14 engaging the longer extending leg or member 20 of the looped end 12 to bias the leg 22 away from the body portion 11 of the bale-tie wire 10, a position as shown in FIG. 5. In such a position the loops 12 and 14 are positioned for proper assembly.

Figure 7:
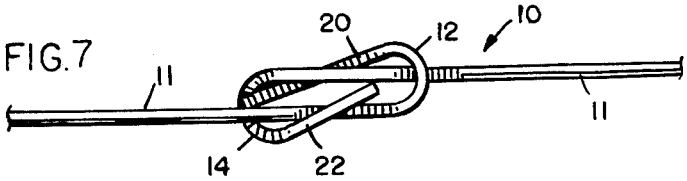
FIG. 7 is a fragmentary top plan view showing the looped ends in accordance with the present invention in partial interlocked position.

During the assembly operation the longer looped end 12 will come into contact with the shorter extending leg 22 to bias the same away from the body portion to permit and eliminate the chance of simultaneously deflecting each of the extending leg portions away from the body portion of the wire as is true of conventional bale-tie wires. FIG. 7 represents the partial overlapping engaged position of the looped ends 12 and 14 together and illustrates the converged engagement and piloting effect of leg 20 in aligning the looped ends for formation of the completed joint.

The bale-tie wire of the present invention is useful in conjunction with press platens of baling presses for baling materials. When the baled material is compressed between the platens, the bale-tie wire 10 is inserted around the bale and engaged, as hereinabove described, to provide a completed joined bale-tie wire knot which requires approximately half the force necessary to assemble conventional looped ends bale-tie wire having extending legs or members of equal length. Additionally, because each of the looped ends of the bale-tie wire in accordance with the present invention are fully closed, such a structure prevents the bale-tie wires from entanglement during shipment and non-usage, a result which has heretofore been unknown in the art.

The novel bale-tie wire in accordance with the present invention permits the utilization of larger diameter bale-tie wire and as the securing medium because the force necessary in completing and engaging the looped ends together is approximately half the force necessary with a conventional bale-tie wire structure. Also, it is within the scope of the present invention to embody looped ends with differences in extending leg lengths to provide sufficient latitude to deflect one leg at a time for sequential operation and engagement. It has been found that a range of one-eighth to four inches relative loop length differential from the end of the extending leg to the outer diameter of the looped end is well within the scope of the present invention.

The novel method of engaging a bale-tie wire results in an operation which susbstantially reduces the force necessary in completing and engaging the looped ends together. The method includes the steps of positioning the unequal sized looped end members of the bale-tie wire in abutting relationship, moving the end of the longer looped end member into contact with the shorter extending leg of the other end member to bias the shorter leg away from the body portion of the bale-tie wire to thereby permit encirclement of the body portion with the longer looped end, engaging the shorter looped end member into contact with the longer extending leg to bias the same away from the body portion to permit encirclement of the smaller looped end portion about the body portion of the bale-tie wire and pulling the looped end members away from one another to provide engagement to complete the joint. Such a method provides an assembly operation which prevents the simultaneous deflecting of each of the looped end portions during engagement and eliminates the substantial force required in joining the looped end members together thereby substantially decreasing the time necessary to manually complete the joint.

I claim:

1. An elongated bale-tie wire comprising a body portion and engaging looped end members integral to said body portion, each of said looped end members being oppositely curved substantially in the plane of said body portion and having a portion bent out of the plane in opposite direction thereof, said looped end members each including legs extending rearwardly from said end members and engageable with said body portion to form a closed loop therewith, and wherein one of said legs on one of said looped end members is longer in length than the other of said legs on the other of said looped end members, said looped end members being selectively and sequentially engageable with one another to form a fastened bale-tie joint about the bale.

2. A method of engaging a bale-tie wire about a bale having looped end members each including legs extending rearwardly from the end members and engageable with the body portion of the bale-tie wire to form a closed loop therewith and wherein one of the legs on one of the looped end members is longer in length than the other of the legs on the other of the looped end members including the steps of:

positioning the looped end members of the bale-tie wire in abutting relationship.

moving the end of the longer looped end member into contact with the shorter extending leg on the other end member to bias the leg away from the body portion of the bale-tie wire to permit the encirclement of body portion of the bale-tie wire with the longer looped end, engaging the end of the shorter looped end member to contact with the longer extending leg of the larger looped end member to bias the same away from the body portion of the bale-tie wire to permit the encirclement of the smaller looped end portion about the body portion of the bale-tie wire, and pulling the looped end members away from one another to provide engagement of the looped ends to complete the bale-tie joint about the bale.

* * * * *